US006857900B2

(12) United States Patent
Kleeberger et al.

(10) Patent No.: US 6,857,900 B2
(45) Date of Patent: Feb. 22, 2005

(54) CABLE CONNECTOR HOLDERS AND METHODS FOR CONNECTING AND DISCONNECTING A PLURALITY OF CABLE CONNECTORS

(75) Inventors: Terry M. Kleeberger, Tacoma, WA (US); Paul W. Robinson, Bainbridge Island, WA (US); Billie D. Eliot, Redmond, WA (US); Daniel J. Bagby, Enumclaw, WA (US)

(73) Assignee: Carlyle, Inc., Tukwila, WA (US)

( * ) Notice: Subject to any disclaimer, the term of this patent is extended or adjusted under 35 U.S.C. 154(b) by 0 days.

(21) Appl. No.: 10/836,585

(22) Filed: Apr. 29, 2004

(65) Prior Publication Data

US 2004/0235344 A1 Nov. 25, 2004

Related U.S. Application Data

(60) Provisional application No. 60/466,759, filed on Apr. 29, 2003.

(51) Int. Cl.[7] ..... H01R 13/60

(52) U.S. Cl. ..... 439/540.1; 439/701; 385/76

(58) Field of Search ..... 439/540.1, 638, 439/368, 369, 344, 676, 701, 372, 298; 385/55, 56, 59, 76; 29/267, 764

(56) References Cited

U.S. PATENT DOCUMENTS 4,997,386 A 3/1991 Kawachi et al.
5,326,279 A 7/1994 Sumida
5,398,295 A * 3/1995 Chang et al. ..... 385/55
5,569,040 A 10/1996 Sumida
6,109,978 A 8/2000 Stellman et al.
6,123,564 A 9/2000 Belmore, III
6,190,192 B1 2/2001 White et al.
6,250,817 B1 6/2001 Lampbert et al.
6,343,950 B1 * 2/2002 Eginton et al. ..... 439/540.1
6,409,392 B1 6/2002 Lampert et al.
6,547,585 B2 4/2003 Bradley et al.
6,595,798 B1 * 7/2003 Pook ..... 439/540.1
6,796,844 B1 * 9/2004 Edwards, III ..... 439/638

* cited by examiner

*Primary Examiner*—P. Austin Bradley
*Assistant Examiner*—Felix O. Figueroa
(74) *Attorney, Agent, or Firm*—Stoel Rives LLP

(57) ABSTRACT

A set of connectors, such as electrical or fiber-optic cable connectors, is supported on a holder body to form a ganged array of cable connectors. The holder body includes a bearing surface for maintaining a latch release of at least a first one of the cable connectors in a disengaged position to prevent it from latching when the ganged array of connectors is connected to an array of mating connectors. The holder body also defines one or more clearance regions that allow the latch release of at least a second one of the cable connectors to operate, to thereby allow the second cable connector to latch when the set of cable connectors is connected to the array of mating connectors, for releasably retaining the set of cable connectors in place. Spaced-apart clearance regions may be provided for facilitating proper operation and preventing damage to cables and connectors.

22 Claims, 2 Drawing Sheets

CABLE CONNECTOR HOLDERS AND METHODS FOR CONNECTING AND DISCONNECTING A PLURALITY OF CABLE CONNECTORS

RELATED APPLICATIONS

This application claims the benefit under 35 U.S.C. § 119(e) of U.S. Provisional Patent Application No. 60/466,759, filed Apr. 29, 2003, which is incorporated herein by reference.

TECHNICAL FIELD

This application relates to holders for multiple connectors, such as electrical or fiber-optic cable connectors, and methods for efficient connection of a plurality of connectors to a corresponding plurality of mating connectors.

BACKGROUND OF THE INVENTION

Devices for holding arrays of electrical connectors, such as RJ-45 or RJ-11 plug connectors, are known. These devices facilitate connection and disconnection of the arrays of plug connectors to and from corresponding arrays of socket connectors in electrical equipment, such as telephone and data network switches, for example.

U.S. Pat. No. 6,109,978 of Stellman et al. and U.S. Pat. No. 6,343,950 of Eginton et al. describe holders including a handle to facilitate connection and disconnection of an array of plug-type electrical connectors. The holders include positioning features for engagement with crimp slots of the electrical connectors, to prevent the connectors from moving relative to the holder following installation. Eginton et al. discloses removing a barb latch of each connector before mounting the connectors in the holder, to eliminate the need to depress the barb latches when disconnecting the array of connectors. In place of the barb latches, Eginton et al. disclose a clip that is mounted between the holder and at least one of the electrical connectors and which does not require manual depression for releasing the connector array.

U.S. Pat. No. 6,123,564 of Belmore, III, and U.S. Pat. No. 6,547,585 of Bradley et al. disclose devices including a connector holder and an elongate latch release bar coupled to the connector holder. A row of RJ-45 plug connectors is mounted in the connector holder for simultaneous insertion into a corresponding array of mating socket connectors. Both the '564 and '585 patents disclose latch release bars that are slidably mounted to the holder and are manipulated to simultaneously depress a latch tab of each plug connector in the connector holder, thereby facilitating simultaneous disconnection of the plug connectors from the array of mating socket connectors.

The present inventors have recognized a need for improved devices for holding a plurality of cable connectors in a ganged array, improved methods of connecting and latching ganged arrays of cable connectors to arrays of mating connectors, and improved methods of disconnecting ganged cable connectors from mating connectors.

SUMMARY

A set of cable connectors, such as electrical or fiber-optic cable connectors, is supported on a holder body in a predetermined spatial relationship corresponding to an array of mating connectors to thereby form a ganged array of cable connectors. The holder body includes a bearing surface for maintaining a latch release of a first one or more of the cable connectors in a disengaged position to prevent them from latching when the set of cable connectors is connected to the mating connectors. The holder body also defines one or more clearance regions that allow the latch release of a second one or more of the cable connectors to operate, to thereby allow the second one or more cable connectors to latch when the set of cable connectors is connected to the array of mating connectors, for releasably retaining the set of cable connectors in place.

In some embodiments, two or more spaced-apart clearance regions are provided so that a user must use two hands to manually depress the latch releases of the two cable connectors aligned with the clearance regions. In other embodiments, the holder body may define a first pair of clearance regions spaced apart from a second pair of clearance regions. The clearance regions of each pair may be located on opposing sides of the holder to encourage a user to pinch the holder body with both hands when depressing the latch release tabs, thereby facilitating grasping and pulling of the holder rather than the cables when disconnecting the ganged array from the corresponding array of mating connectors.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
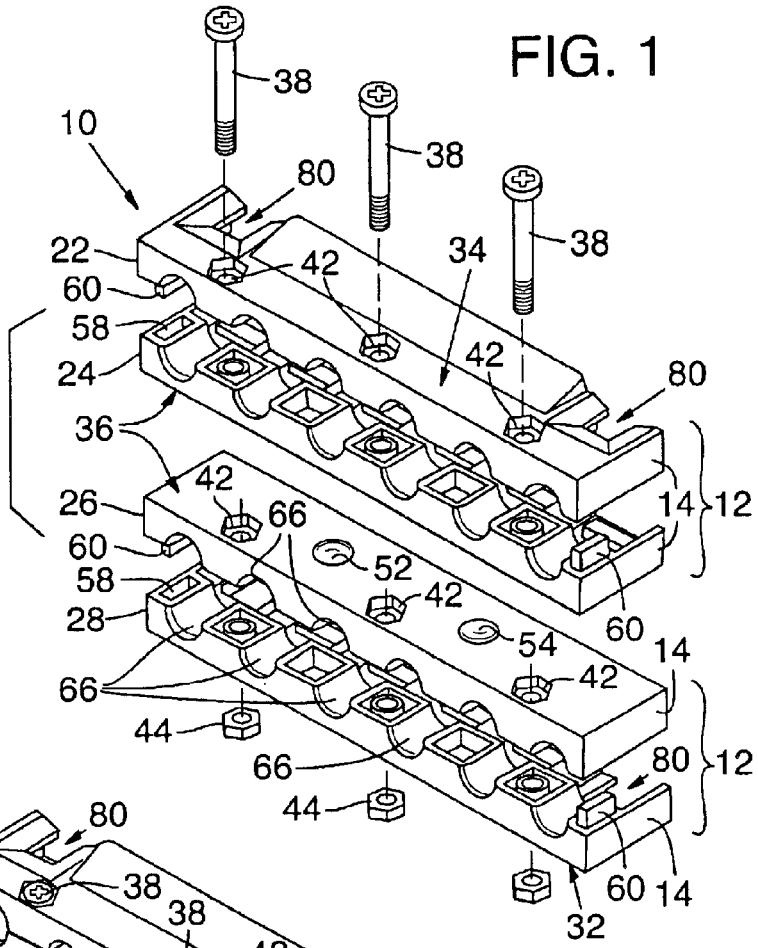
FIG. 1 is an exploded isometric view of a connector holder in accordance with a preferred embodiment.
Figure 2:
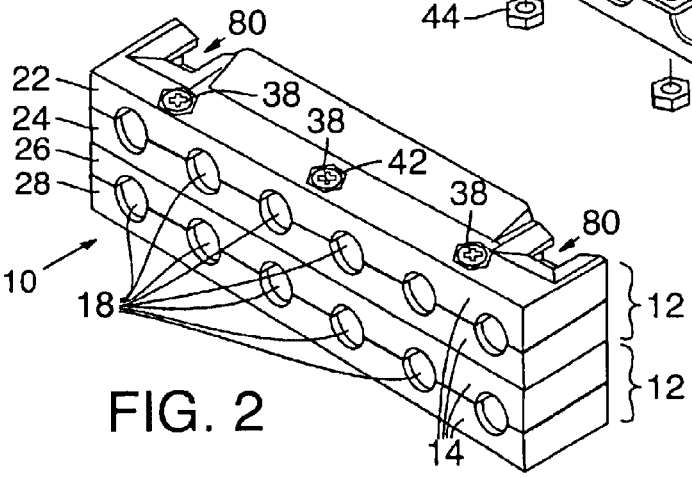
FIG. 2 is an assembled isometric view of the connector holder of FIG. 1.
Figure 3:
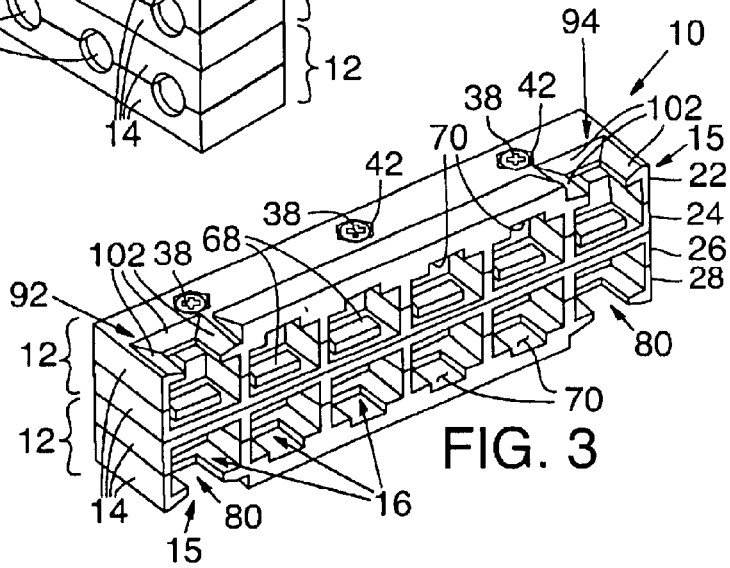
FIG. 3 is an isometric view of the reverse side of the connector holder of FIG. 2.
Figure 4:
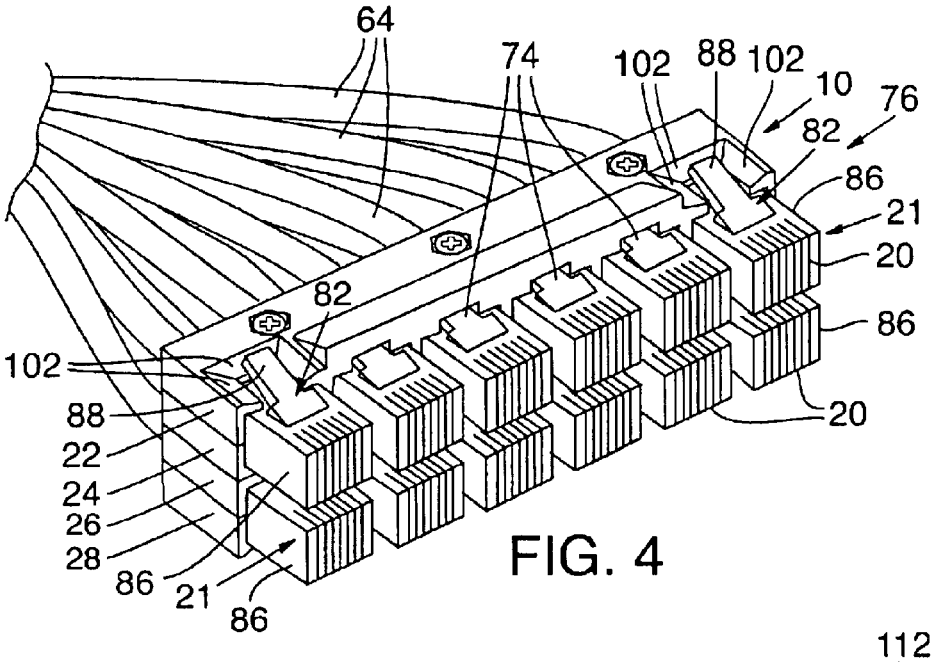
FIG. 4 is a pictorial view the holder of FIG. 3 holding twelve cables with RJ-45 connectors in a ganged array.

FIG. 1 shows an exploded isometric view of a connector holder 10 in accordance with a preferred embodiment. FIGS. 2 and 3 show front and rear isometric views of connector holder 10. With reference to FIGS. 1–3, connector holder 10 preferably comprises a pair of holder bodies 12, each holder body 12 including a set of body sections 14 clamped together and cooperating to define a row 15 of connector receptacles 16. In the preferred embodiment, each receptacle 16 is sized and shaped to hold a single RJ-45 connector 20 (FIG. 4). In other embodiments, receptacles 16 may be sized and shaped to hold another kind of electrical or fiber-optic cable connector. The pairs of holder body sections 14 of each holder body 12 also define a set of cable-receiving passages 18 communicating with the connector receptacles 16.

Each holder body 12 forms an operative unit and can be used separately to hold a row 21 (FIG. 4) or other ganged array 76 of cabled connectors 20. However, when two holder bodies 12 are stacked together as shown in FIGS. 2 and 3, they collectively form a compact two-row holder. Thus, connector holder 10 may include first, second, third, and fourth body sections 22, 24, 26, and 28, respectively. In some embodiments, second and third body sections 24 and 26 may be integrated to form a central section, which may comprise a single unitary part. In other embodiments, body sections may be designed to form stacks of 3 or more rows 15 of receptacles 16. In still other embodiments, holder body 12 may comprise a single body section or other structure for supporting a set of cabled connectors 20 in a predetermined spatial relationship corresponding to an array of mating connectors. Body sections 14 may also be shaped to hold cabled connectors 20 in ganged arrays other than regular rectangular arrays. Thus, the terms "array" and "ganged array" used herein are to be construed broadly to encompass various arrangements of various kinds of connectors, including, but not limited to regular rectangular arrays of like connectors.

Body sections 14 are preferably formed of an injection molded plastic resin, such as glass-filled nylon, for example. However, other materials, such as metal, could also be used. For ease of manufacture, fourth body section 28 is preferably identical to first body section 22, but reversed in orientation so that an underside 32 of fourth body section 28 is identical to a top side 34 of first body section 22, for example. Similarly, third body section 26 is preferably identical to second body section 24, but reversed. Thus, the entire connector holder 10 is symmetrical about the adjoining faces 36 of second and third body sections 26 and 28, and can be assembled from a small number of unique parts, in various quantities and combinations.

A set of bolts 38 are inserted through aligned bolt holes 42 in body sections 22, 24, 26, and 28 and threadably fastened with nuts 44 to clamp together the sections 22, 24, 26, and 28 of holder body 12. Second and third body sections 24 and 26 include a pair of alignment features, preferably including one locating bump 52 and one locating recess 54 formed on each of the second and third body sections 24 and 26. When stacked together, the locating bump and locating recess on the second body section 24 (not visible in FIG. 1) nest with the respective locating recess 52 and locating bump 52 of third body section 26 to help align bolt holes 42 of the connector holders 12 and to precisely align the rows of receptacles 16. Body sections 14 may also include other alignment features, such as a mortise 58 and tenon 60, for aligning and joining the body sections 14 of each holder body 12. Moreover, devices other than bolts 38 and nuts 44 may be used for fastening body sections 22, 24, 26, and 28 together. For example, a snap-fit connection may be employed in alternative embodiments, to both align the body sections 14 and fasten them together.

FIG. 4 is a pictorial view of connector holder 10 of FIGS. 1–3, holding two rows 15 of six cabled connectors 20 each, it being understood that embodiments of connector holder 10 are envisioned which for holding as few as two connectors 20 and as many as dozens of connectors 20. With reference to FIG. 4, a plurality of RJ-45 plug connectors are shown terminating multiple electrical cables 64, which extend through cable-receiving passages 18 in holder body 12. Preferably, cable receiving passages 18 are preferably sized to accommodate a range of different cable types and thicknesses, the largest of which may be secured by a clamping force of opposing pairs of semi-cylindrical cable passage sections 66 of body sections 14 (FIG. 1), to thereby provide strain relief and prevent the cables 64 from being pulled loose from connectors 20.

Each of the connectors 20 is held in place in connector holder 10 by a positioning member 68 formed on an interior wall of holder body 12. Positioning member 68 preferably comprises a raised locating block that is sized to fit in a crimp slot of an RJ-45 plug connector. Other kinds of positioning features may be included for engaging crimp slots, connector body ribs, or other structural features of the connector 20, especially if connector is other than an RJ-45 plug connector.

Figure 5:
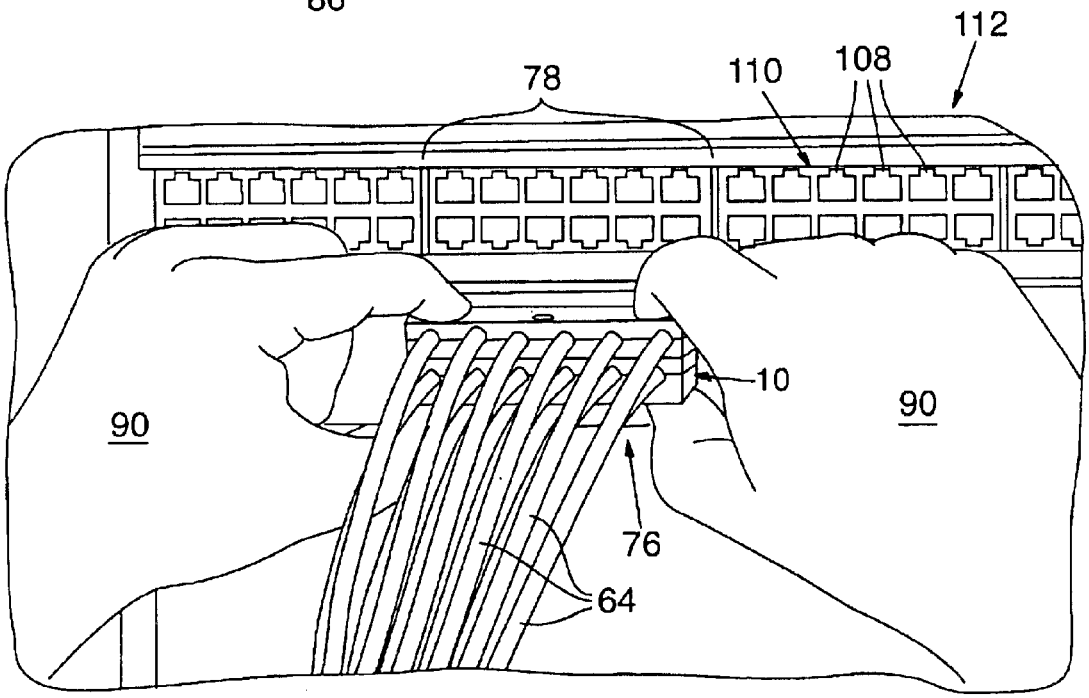
FIG. 5 is a pictorial view depicting the ganged array of connectors of FIG. 4 being disconnected from a corresponding set of mating connectors of a patch panel of a data network switch.

Holder body 12 includes a bearing surface 70 bordering one or more of the receptacles 16, for depressing a latch release 74 of at least one of the cabled connectors 20 and maintaining the latch release 74 in a disabled position. Holding some of the latch releases 74 in a disabled position prevents them from latching when the ganged array of connectors 76 (FIG. 4) is connected to an array of mating connectors 78 (FIG. 5). In the preferred embodiment, all but two of the receptacles 16 in each row 15 is bordered by a bearing surface 70 for holding the latch releases of all but two of the connectors 20 in the row 21 in a disabled position. Bearing surface 70 may comprise multiple structural walls or non-contiguous surfaces of one or more of the body sections 14, as in the preferred embodiment shown. In other embodiments, not shown, bearing surface 70 is a contiguous surface that contacts the latch releases 74 of multiple connectors 20.

Each holder body 12 also defines one or more clearance regions 80 (FIGS. 1–3) that are positioned adjacent one or more of the receptacles 16 holding latching one(s) 86 of the connectors 20 and sized to allow the latches 82 thereof to operate and latch when the ganged array of cable connectors 76 is connected to the array of mating connectors 78. In the preferred embodiment shown, clearance region 80 comprises an opening, such as a notch or slot along top side 34 of first body section 22 that is large enough to allow the distal end of latch release tab 88 of latch 82 to extend from receptacle 16 and move freely so that the latch 82 will engage and lock the ganged array of connectors 76 in place when it is moved fully into engagement with the array of mating connectors 78. Clearance region 80 need not comprise an opening and may, alternatively, include a shrouded space within receptacle 16, for example. In other embodiments, clearance region 80 may take other forms, shapes, and arrangements, to accommodate the manual operation of different kinds of latching or latch release devices.

Multiple spaced-apart clearance regions 80 are preferably provided so that a user must use two hands 90 to manually depress the latch release tabs 88 of the latching connectors 86 when disconnecting the ganged array of connectors 76, as depicted in FIG. 5. In other embodiments, the holder body 12 may define a first pair of clearance regions 92 spaced apart from a second pair of clearance regions 94. The clearance regions of each pair 92, 94 may be located on opposing sides of connector holder 10 to encourage a user to pinch holder bodies 12 with both hands when depressing the latch release tabs 88, thereby facilitating grasping and pulling of the connector holder 10 (rather than the cables 64) when disconnecting the ganged array 76 from the corresponding array of mating connectors 78.

Each holder body 12 preferably includes a depression 102 adjacent each clearance region 80 to admit a portion of a user's finger (including a user's thumb) when depressing the operational latch release tab(s) 88 of the latching connectors 86. Depressions 102 assist with manual gripping of connector holder 10, thereby facilitating disconnection of the ganged array of connectors 76 from the array of mating connectors 78.

Advantageously, the compact size of connector holder 10 may facilitate its use for connecting cables 64 with ports 108 of high density connector arrays 110 of the type found on modern network switch devices 112 (FIG. 5).

It will be obvious to those having skill in the art that many changes may be made to the details of the above-described embodiments without departing from the underlying principles of the invention. For example, the preferred embodiments are described herein with reference to electrical cables and RJ-45 plug connectors. However, embodiments are envisioned for holding connectors for different kinds of cables, such as fiber-optic cables, and for holding different kinds of connectors, such as socket connectors, for example. The scope of the present invention should, therefore, be determined only by the following claims.

What is claimed is:

1. A device for facilitating efficient connection of a set of electrical connectors to an array of mating connectors, comprising:

a body including a set of positioning members for holding a set of electrical connectors in a predetermined spatial relationship corresponding to an array of mating connectors, the body including:

a bearing surface for depressing a latch release of at least a first one of the electrical connectors and maintaining the latch release in a disabled position to thereby prevent the first electrical connector from latching with a corresponding mating connector; and a clearance region that allows a latch release of a second one of the electrical connectors to move freely, to thereby allow the second electrical connector to latch when the set of electrical connectors is connected to the array of mating connectors.

2. A device according to claim 1, wherein the body includes a depression adjacent the clearance region to admit a portion of a user's finger for depressing the latch release of the second electrical connector and for gripping the body, thereby facilitating disconnection of the set of electrical connectors from the array of mating connectors.

3. A device according to claim 1, wherein the body includes opposing first and second sections joined together around at least some of the electrical connectors.

4. A device according to claim 1, wherein the body includes:

a first section defining the bearing surface and the clearance region; and a second section aligned with the first section.

5. A device according to claim 4, wherein the first and second sections cooperate to define a first row of receptacles for holding a first portion of the electrical connectors, and the body further includes:

a third section positioned adjacent the second section opposite the first row of receptacles; and a fourth section cooperating with the third section to define a second row of receptacles for holding a second portion of the electrical connectors.

6. A device according to claim 5, wherein the first and fourth sections are identical and the second and third sections are identical.

7. A device according to claim 5, wherein the second and third sections include alignment features for facilitating alignment thereof.

8. A device according to claim 5, further comprising a fastener that joins together the first, second, third, and fourth sections.

9. A device according to claim 1, wherein:

the spatial relationship includes first and second rows of electrical connectors; and the body includes a central section interposed between the first and second rows of electrical connectors, and a pair of outer sections clamping the first and second rows of electrical connectors against the central section.

10. A device according to claim 1, wherein the body includes multiple cable-receiving passages aligned with the positioning members and sized to allow cables attached to the electrical connectors to pass therethrough.

11. A device according to claim 10, wherein the body clamps the cables at the cable-receiving passages to thereby prevent the cables from being pulled loose from the electrical connectors.

12. A device according to claim 1, wherein the positioning members are sized to seat in a crimp slot of the electrical connectors.

13. A method of connecting a plurality of electrical or fiber-optic cable connectors to an array of mating connectors, comprising:

supporting a plurality of cable connectors on a body that holds the cable connectors in a predetermined spatial relationship corresponding to the array of mating connectors, thereby forming a ganged array of cable connectors;

maintaining a latch release of at least a first one of the cable connectors in a disabled position so that the first cable connector is prevented from latching with a corresponding mating connector; and allowing a latch release of at least a second one of the cable connectors to operate so that, when the set of cable connectors is connected to the array of mating connectors, a latch of the second cable connector engages to retain the ganged array of cable connectors in place.

14. A method according to claim 13, further comprising moving the ganged array of cable connectors toward the array of mating connectors until the set of cable connectors mates with the array of mating connectors and the latch of the second cable connector is engaged.

15. A method according to claim 13, further comprising manually operating the latch release of the second cable connector to disengage the latch.

16. A method according to claim 13, further comprising manually depressing the latch release of the second cable connector; and while manually depressing the latch release, grasping the body and pulling it away from the array of mating connectors to thereby disconnect the set of cable connectors from the array of mating connectors.

17. A method according to claim 16, wherein the step of grasping the body includes grasping the body with two hands.

18. A method according to claim 13, wherein the step of supporting the cable connectors on the body includes clamping the cable connectors between opposing first and second sections of the body.

19. A method according to claim 13, wherein the step of supporting the cable connectors on the body includes arranging the cable connectors in first and second rows on opposing sides of a central section of the body and clamping the first and second rows of the cable connectors between a pair of outer sections of the body.

20. A ganged array of electrical or fiber-optic cable connectors, comprising:

a set of cable connectors including a first cable connector and a second cable connector each having a latch release extending outwardly therefrom, the set of cable connectors arranged in a predetermined spatial relationship corresponding to an array of mating connectors; and a holder body supporting and retaining the set of cable connectors in the predetermined spatial relationship to thereby facilitate ganged connection of the set of cable connectors to the corresponding array of mating connectors, the holder body including a bearing surface that bears against the latch release of the first cable connector and holds said latch release in a depressed position to prevent the first cable connector from latching with a corresponding mating connector, and the holder body defining a clearance region positioned in alignment with the latch release of the second cable connector to allow said latch release to operate when the set of cable connectors is connected to the array of mating connectors, for releasably retaining the set of cable connectors in place.

21. A ganged array of cable connectors according to claim 20, wherein the set of cable connectors includes first and second rows of cable connectors.

22. A ganged array of cable connectors according to claim 20, wherein the body defines two pairs of opposing clearance regions positioned in alignment with the latch releases of four of the cable connectors to allow the latch releases of said four cable connectors to operate when the set of cable connectors is connected to the array of mating connectors, one of the pairs of clearance regions being spaced apart from the other of the pairs of clearance regions so as to necessitate the use of two hands to manually depress the latch releases of the four cable connectors when disconnecting the set of cable connectors from the corresponding mating connectors.

* * * * *